US010848863B2

(12) United States Patent
Peace, Jr.

(10) Patent No.: US 10,848,863 B2
(45) Date of Patent: Nov. 24, 2020

(54) ACOUSTIC RADIATION PATTERN CONTROL

(71) Applicant: HARMAN INTERNATIONAL INDUSTRIES, INCORPORATED, Stamford, CT (US)

(72) Inventor: Paul Wayne Peace, Jr., Viejo, CA (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

(21) Appl. No.: 16/070,047

(22) PCT Filed: Jan. 13, 2017

(86) PCT No.: PCT/US2017/013381

§ 371 (c)(1),
(2) Date: Jul. 13, 2018

(87) PCT Pub. No.: WO2017/123906

PCT Pub. Date: Jul. 20, 2017

(65) Prior Publication Data

US 2019/0037306 A1 Jan. 31, 2019

Related U.S. Application Data

(60) Provisional application No. 62/278,940, filed on Jan. 14, 2016.

(51) Int. Cl.
*H04R 3/00* (2006.01)
*H04R 1/34* (2006.01)
(Continued)

(52) U.S. Cl.
CPC ..... *H04R 1/345* (2013.01); *H04R 1/025* (2013.01); *H04R 1/403* (2013.01); *H04R 3/04* (2013.01);
(Continued)

(58) Field of Classification Search
CPC . H04R 1/20; H04R 1/32; H04R 1/323; H04R 1/403; H04R 2201/405; H04R 1/025; H04R 3/04; H04R 3/12
(Continued)

(56) References Cited

U.S. PATENT DOCUMENTS 5,233,644 A * 8/1993 Yamagata ..... H04M 1/73 379/354
5,233,664 A * 8/1993 Yanagawa ..... H04R 1/403 381/182
(Continued)

FOREIGN PATENT DOCUMENTS

CN 1754403 A 3/2006
CN 1965608 A 5/2007
(Continued)

OTHER PUBLICATIONS

International Search Report and Written Opinion for Application No. PCT/US2017/013381, dated May 25, 2017, 10 pages.
(Continued)

*Primary Examiner* — Disler Paul
(74) *Attorney, Agent, or Firm* — Brooks Kushman P.C.

(57) ABSTRACT

One or more embodiments of the present disclosure utilize two distinctly different radiation devices aimed in the same direction to create a derived acoustic radiation pattern. The radiation devices may be distinctly different in terms of the acoustic radiation pattern each radiation device generates individually. The derived acoustic radiation pattern is unique to the individual acoustic radiation patterns of either of the two radiation devices. Manipulation of several key design variables allows a multitude of unique patterns to be derived in this way using only the two radiation devices. In turn, this allows for engineering an acoustic radiation pattern to match the unique geometry of a room.

19 Claims, 4 Drawing Sheets

(51) Int. Cl.

| | |
|---|---|
| ***H04R 1/40*** | (2006.01) |
| ***H04R 5/02*** | (2006.01) |
| ***H04R 1/02*** | (2006.01) |
| ***H04R 3/04*** | (2006.01) |
| ***H04R 3/12*** | (2006.01) |

(52) U.S. Cl.
CPC ..... *H04R 3/12* (2013.01); *H04R 5/02* (2013.01); *H04R 2201/405* (2013.01)

(58) Field of Classification Search
USPC ..... 381/335, 97–98, 89
See application file for complete search history.

(56) References Cited

U.S. PATENT DOCUMENTS

| | | | | |
|---|---|---|---|---|
| 5,497,425 | A | 3/1996 | Rapoport | |
| 5,793,876 | A * | 8/1998 | Derogis | H04R 5/02 381/332 |
| 5,870,484 | A | 2/1999 | Greenberger | |
| 6,513,622 | B1 | 2/2003 | Gelow et al. | |
| 7,027,605 | B2 | 4/2006 | Werner | |
| 7,426,278 | B2 | 9/2008 | Meynial | |
| 8,457,324 | B2 * | 6/2013 | Tice | G08B 7/062 381/71.7 |
| 8,620,010 | B2 * | 12/2013 | Gunnarsson | H04R 1/403 381/303 |
| 8,873,787 | B2 | 10/2014 | Bergere et al. | |
| 8,891,782 | B2 * | 11/2014 | Kim | H04R 1/323 381/59 |
| 9,100,748 | B2 | 8/2015 | Hartung et al. | |
| 9,286,898 | B2 | 3/2016 | Xiang et al. | |
| 2003/0194098 | A1 | 10/2003 | Werner et al. | |
| 2005/0152562 | A1 * | 7/2005 | Holmi | H04S 7/307 381/86 |
| 2007/0041590 | A1 * | 2/2007 | Tice | G08B 7/062 381/77 |
| 2017/0347191 | A1 * | 11/2017 | Button | H04R 1/323 |
| 2018/0262836 | A1 * | 9/2018 | Janes | H04R 3/14 |
| 2018/0352333 | A1 * | 12/2018 | Kriegel | H04R 3/04 |

FOREIGN PATENT DOCUMENTS

| | | | |
|---|---|---|---|
| CN | 101583061 | A | 11/2009 |
| CN | 101682814 | A | 3/2010 |
| CN | 101895801 | A | 11/2010 |
| CN | 102006534 | A | 4/2011 |
| CN | 102197659 | A | 9/2011 |
| CN | 104285450 | A | 1/2015 |
| CN | 104919824 | A | 9/2015 |

OTHER PUBLICATIONS

Office Action of Chinese Application No. 201780006786.X dated Jul. 2, 2019, 14 pages.
Office Action of Chinese Application No. 201780006786.X dated Apr. 2, 2020, 14 pages.

* cited by examiner

ACOUSTIC RADIATION PATTERN CONTROL

CROSS-REFERENCE TO RELATED APPLICATION

This application is the U.S. national phase of PCT Application No. PCT/US2017/013381 filed on Jan. 13, 2017, which claims the benefit of U.S. provisional application Ser. No. 62/278,940 filed Jan. 14, 2016, the disclosures of which are incorporated in their entirety by reference herein.

TECHNICAL FIELD

The present disclosure relates to acoustic radiation pattern control using different acoustic radiation devices.

BACKGROUND

Loudspeaker coverage providing sound for a space, must interface with the audience positioned throughout the space to provide uniform sound coverage. However, the space is typically asymmetric from the loudspeaker directivity perspective and not uniform in size. Loudspeakers at different locations in the room demand a different envelope shape. For example, cinema surround loudspeakers see a very different room geometry than screen loudspeakers. Further, a side wall surround sees a very different room geometry than a rear wall surround.

SUMMARY

According to one embodiment, a dual-array loudspeaker is provided. A primary transducer produces a primary radiation pattern in a primary plane. A secondary transducer is positioned a distance in the primary plane from the primary transducer and produces a secondary radiation pattern different from the primary radiation pattern in the primary plane, wherein the secondary radiation pattern modifies the primary radiation pattern to produce a derived primary radiation pattern different from the primary and secondary radiation patterns in the primary plane.

In another embodiment, the central axes of radiation of the primary and secondary transducers lie on the primary plane.

In another embodiment, the central axes of radiation of the primary and secondary transducers are generally parallel and spaced apart by the distance in the primary plane.

In another embodiment, the primary plane is a vertical plane.

In another embodiment, the secondary transducer manipulates the primary radiation pattern in a primary plane to achieve the derived primary radiation pattern.

In another embodiment, the primary and secondary transducers have a center frequency being generally the same. The primary and secondary transducers are spaced apart a distance is generally equal to 1.5 times the center frequency of the primary and secondary transducers, wherein the distance is measured between a central axis of radiation of each of the primary and secondary transducers.

In another embodiment, the secondary transducer operates at a sound output level being less than a primary sound output level.

In another embodiment, at least one of the primary and secondary transducers includes a first electronic filtering mode and a second electronic filtering mode. The derived primary radiation pattern has a first derived radiation pattern based on the first electronic filtering mode and a second derived radiation pattern based on the second electronic filtering mode.

In another embodiment, the first electronic filtering mode is a side mode and the second electronic filtering mode is a rear mode.

According to one other embodiment, a dual-array loudspeaker is provided with a first transducer having a first central axis of radiation and produces a first radiation pattern oriented at a first angle from the first central axis of radiation. A second transducer has a second central axis of radiation generally parallel to the first central axis of radiation and produces a second radiation pattern oriented at a second angle from the second central axis of radiation. A derived radiation pattern is oriented at a derived radiation angle different than the first and second angles when the first and second radiation patterns are combined.

In another embodiment, the derived radiation angle is not parallel to the first and second central axes of radiation.

In another embodiment, the first transducer has a first filtering function and the second transducer has a second filtering function different than the first filtering function.

According to one other embodiment, a method is provided and includes generating a primary radiation pattern with a primary transducer. A secondary radiation pattern different from the primary transducer is generated with a secondary transducer. The primary radiation pattern is manipulated with the secondary radiation pattern to produce a derived primary radiation pattern different from the primary and secondary radiation patterns.

In another embodiment, the method includes positioning the secondary transducer a distance away in the primary plane from the primary transducer, wherein central axes of radiation of the primary and secondary transducers lie on the primary plane.

In another embodiment, the method includes changing a filtering function of at least one of the primary and secondary transducers. The derived primary radiation pattern is changed from a first mode to a second mode in response to changing the filtering function.

In another embodiment, the derived primary radiation pattern is oriented at a derived angle being different than a radiation angle of the primary and secondary transducers.

In another embodiment, the method includes operating the primary transducer at a primary sound output level being greater than a secondary sound output level of the secondary transducer.

DETAILED DESCRIPTION

As required, detailed embodiments of the present invention are disclosed herein; however, it is to be understood that the disclosed embodiments are merely examples of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Professional loudspeakers are required to exhibit engineered acoustic radiation patterns. This is accomplished in a multitude of ways including the use of horns and numerous line array techniques. Thus, pattern creation is an important engineering task in the design of any loudspeaker. Actual room shapes require radiation patterns that are often impossible for single devices to achieve. Single devices have patterns that are naturally smooth and rounded in shape where room geometries require much sharper transitions, often in areas off the radiation axis, which is near impossible to create from a single device.

Patterns having sharp transitions and unique shapes can be achieved when multiple acoustic devices having the same pattern are directed in the same direction. This is the basis of line array behavior where acoustic interference that can be both constructive and destructive and is governed primarily by the acoustic time of flight differential from each device, which means it is wavelength (frequency) dependent. Prior known techniques utilize arrays of the same devices (usually more than two) into the same space (i.e., "line arrays") or devices (similar and dissimilar) aimed in different directions (i.e., "clusters") to create unique radiation patterns. In general, devices aimed in the same direction intensify the energy lobe and those aimed in different directions spread the energy lobe.

One or more embodiments of the present disclosure utilize two distinctly different radiation devices aimed in the same direction to create a derived acoustic radiation pattern. The radiation devices may be distinctly different in terms of the acoustic radiation pattern each radiation device generates individually. The derived acoustic radiation pattern is unique to the individual acoustic radiation patterns of either of the two radiation devices. Manipulation of several key design variables allows a multitude of unique patterns to be derived in this way using the same two radiation devices. In turn, this allows for engineering an acoustic radiation pattern to match the unique geometry of a room.

Figure 1:
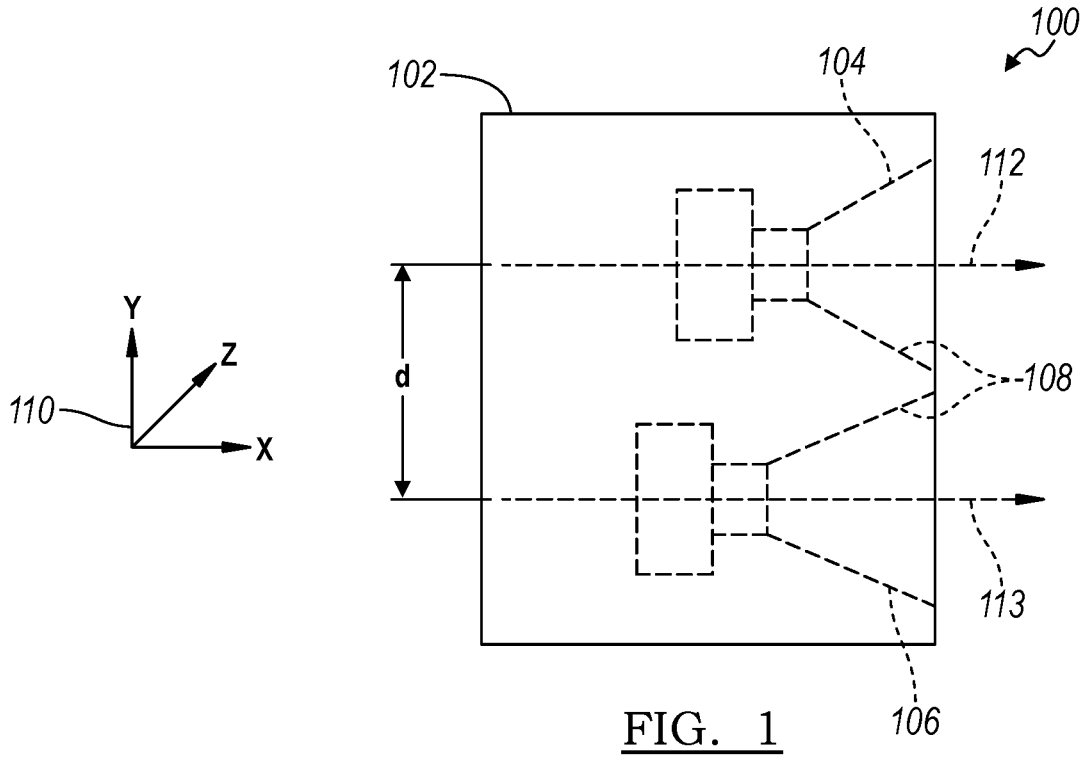
FIG. 1 is a simplified, exemplary schematic side view of a loudspeaker, according to one or more embodiments of the present disclosure.

FIG. 1 illustrates a simplified, exemplary schematic side view of loudspeaker 100 in accordance with one or more embodiments of the present disclosure. The loudspeaker 100 may be a surround sound loudspeaker, such as a side surround speaker or a rear surround speaker. According to one or more embodiments, the loudspeaker 100 may be a professional cinema surround speaker. Professional cinema surrounds present a unique case where the same sound characteristic is required from multiple different locations in a theater. Each loudspeaker "sees" a distinctly different room geometry. Ideally, the requirement of cinema surrounds is for each surround loudspeaker to cover the room identically. This mandates a distinctly different radiation pattern from each loudspeaker location, but with the same sound characteristic. Further, each surround loudspeaker is required to provide the same sound characteristic to the entire theater. Although certain aspects of the present disclosure may be described with respect to professional cinema surrounds, the loudspeaker described herein may be any type of loudspeaker.

The loudspeaker 100 includes an enclosure 102 and a pair of radiation devices 104, such as a first transducer 104 and a second transducer 106. According to one or more embodiments, the first transducer 104 and the second transducer 106 may be high-frequency acoustic radiation devices. For example, a high frequency device operates in the audible range above 1,000 Hz. A device may also be considered high-frequency within the range of typically 2,000 Hz-20,000 Hz, and having a corresponding wavelength in the range of approximately 6 inches to 0.6 inches. Wavelengths for mid-frequency and low-frequency transducers may be too large for useful pattern control due to size constraints on the enclosure. For example, a mid-range device operates in the range of 200 Hz-2000 Hz and having a corresponding wavelength of approximately 60 inches to 6 inches. Aspects of the present disclosure, however, may be employed using mid-frequency and low-frequency transducers when not constrained by the enclosure size. The pair of radiation devices 104, 106 may be the same or may be similar devices. Each radiation device 104, 106 may be coupled to a corresponding waveguide 108.

Figure 2:
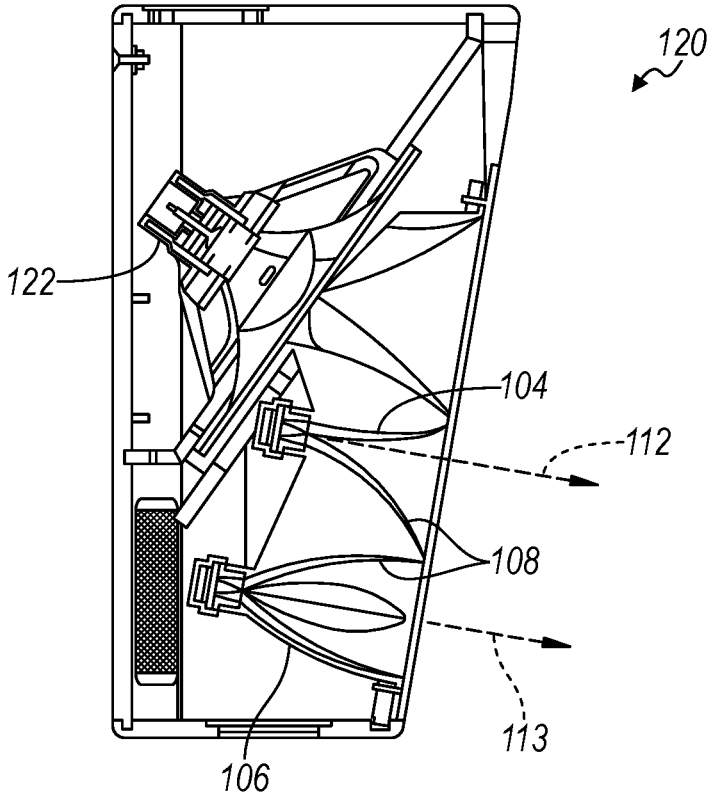
FIG. 2 is an exemplary side, cross-sectional view of the loudspeaker, according to one or more alternate embodiments of the present disclosure.

While the loudspeaker 100 having first and second radiation devices 104, 106 manipulates the acoustic radiation pattern in all directions to some extent, it is important to note there is a primary plane 110 of operation. As shown in FIG. 1, the first and second radiation devices 104, 106 are aligned in a plane 110 so that the central axes of radiation 112, 113 lie in the plane 110. The central axes of radiation 112, 113 of both the first and second radiation devices 104, 106 are oriented in the same direction so that the axis of radiation 112 of the first radiation device 104 is generally parallel to the axis of radiation 113 of the second radiation device 106. The pair of radiation devices 104 may be displaced from each other in the primary plane. As shown in FIGS. 1 and 2, the primary plane 110 may be the vertical plane. Since the two radiation devices are distinctly different, this can be true in all directions. Therefore, the derived radiation pattern may include manipulations in all planes. It should be understood, however, the primary plane 110 may have the greatest degree of freedom.

In one embodiment, one of the radiation devices serves as a primary device and the other a secondary device. For instance, the first transducer 104 may serve as a primary transducer which generates a primary radiation pattern 114 (FIG. 3) and the second transducer 106 then serves as a secondary transducer for generating a secondary 'manipulator' radiation pattern 116 (FIG. 4). For example, the primary transducer may have an energy level of at least 3 dB, whereas the secondary transducer has an energy level less that the primary energy level. While the primary transducer produces a primary pattern, or dominate pattern, at a higher energy level, the secondary transducer works to manipulate the primary pattern to achieve a derived radiation pattern.

Figure 7:
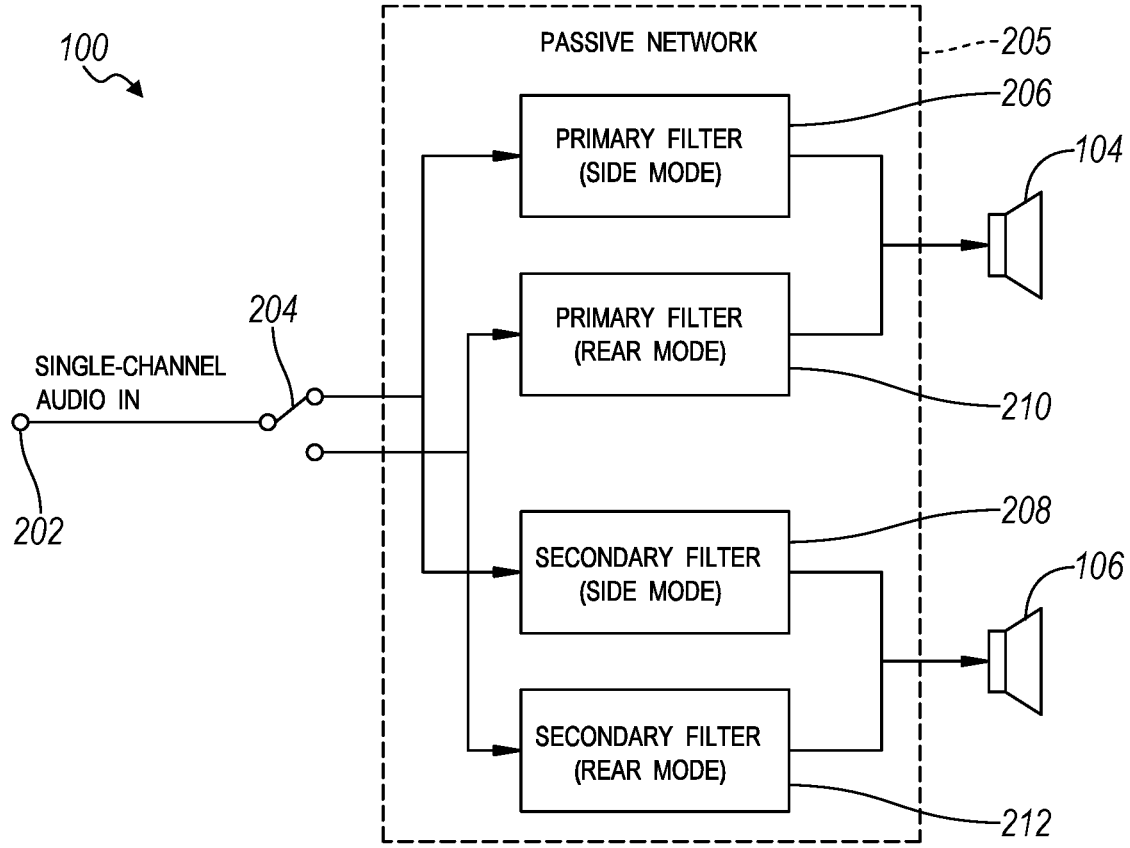
FIG. 7 is a simplified, exemplary block diagram of the loudspeaker of FIG. 1, according to one or more embodiments of the present disclosure.
Figure 8:
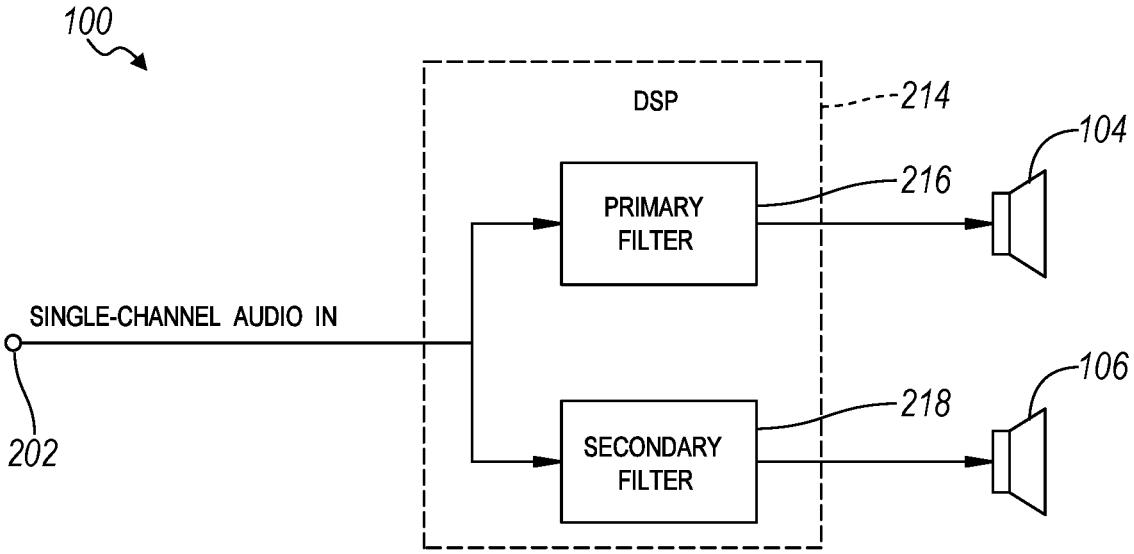
FIG. 8 is another simplified, exemplary block diagram of the loudspeaker of FIG. 1, according to one or more alternate embodiments of the present disclosure.

As previously described, the first transducer 104 may differ from the second transducer 106 by the acoustic radiation pattern it emits. Accordingly, the loudspeaker 100 may derive a unique acoustic radiation pattern by employing a technique that aims two dramatically different radiation patterns in the same direction. The secondary radiation pattern 114 may differ from the primary radiation pattern 116, though it may be pointed in the same direction. In this manner, the secondary radiation pattern 116 may be used to alter the primary radiation pattern 114 to generate the resulting unique acoustic radiation pattern 118 (FIGS. 7-8). Altering the amounts and timing of the secondary radiation pattern 116 to the primary radiation pattern 114 can create completely different results. The primary and secondary roles can be reversed between first transducer 104 and the second transducer 106 giving completely different results yet again. The multitude of resulting acoustic radiation patterns 118 are typically shapes not attainable from single radiation devices alone or from combinations of similar radiation patterns alone, and can be quite useful in mapping to asymmetric room geometries.

FIG. 2 is an exemplary side, cross-sectional view of a loudspeaker 120, according to another embodiment of the present disclosure. In addition to a pair of radiation devices 104, 106 the loudspeaker 120 may include additional radiation devices not involved in specifically engineering the acoustic radiation pattern derived from the pair of radiation devices 104. For example, the loudspeaker 120 may include a low-frequency transducer 122, such as a woofer, for handling lower-frequency audio on the audible sound spectrum. The lower-frequency audio produced by the low-frequency transducer 122 may have minimal, if any, impact on the acoustic radiation pattern shaping of the audio emitted by the pair of radiation devices, the first transducer 104 and the second transducer 106.

The loudspeakers 100, 120 of the present disclosure having two radiation devices 104, 106 may have several advantages. First, one radiation pattern from a secondary transducer 106 can make useful manipulations to a primary transducer 104 while sound output level being up to 20 dB below the primary transducer 104. This is particularly true in the fringes of the derived radiation pattern 118 where the primary radiation pattern 114 may be naturally attenuated and the secondary radiation pattern 116 can be used to either boost this area or attenuate the primary radiation pattern 114, depending on the requirement.

In one embodiment, the angular width of the radiation patterns 114, 116 in the primary plane may be different with different shapes. In this case, three very different shape combinations can exist: (1) the narrow pattern may be dominant and the wide pattern may be used to alter the fringes, either constructive or destructive; (2) the wide pattern may be dominant and the narrow pattern may be used to sharpen the pattern at a certain area; or (3) both radiation patterns may be used in tandem and major shape alteration occurs including lobe alteration, anti-lobe creation, and lobe steering—all manipulated by electronic filtering. It some frequencies, such as lower frequencies neither pattern may be the primary pattern and the first and second patterns used in tandem to achieve the derived radiation pattern.

Any acoustic device is frequency dependent due to the fact audible wavelengths vary by a factor of 1000. Loudspeaker design requires careful attention to frequency dependent behavior. In this way, the loudspeaker 100, 120 has four operable frequency design regions, each approximately one octave wide. FIG. 3-6 illustrate the frequency regions in which the derived radiation patterns from the dual-array transducers 104, 106 have the most impact.

The most critical of these ranges may be the center frequency region 130. The center frequency region 130 may be the region with the most radiation pattern shape control and may be chosen for the application. The wavelength of the center frequency ($\lambda_c$) may be an important dimension in the loudspeaker design. For instance, an approximate distance d (FIG. 1) between the pair of radiation devices 104 may be chosen to be approximately $1.5\lambda_c$, or one and a half times the center frequency wavelength. This may also establish the average dimension of each radiation device in the primary plane, also approximately $1.5\lambda_c$. This may ensure good pattern control from each device in the center frequency range and a wide operational solid angle of pattern control. In one example, the center frequency may be approximately 4,000 Hz and the corresponding $\lambda_c$ is approximately 5 inches.

One octave below the center frequency is a lower frequency region 132 where sound wavelengths grow large enough that each radiation device begins to lose pattern control capability. The loudspeaker 100, 120 of the present disclosure combat this phenomenon by alterations in the filtering to each of the pair of radiation devices 104, 106. In the lower frequency region 132, neither radiation device 104, 106 may serve as primary but both may be used in tandem. In this manner, the general control frequency may be extended a full octave while allowing for a much more gradual and controlled transition away from the engineered radiation pattern. Frequency control can be extended even further below the lower frequency region by proper system crossover design into the lower frequency device 122 in the loudspeaker 120.

One octave above the center frequency is the first upper frequency region 134 where the frequencies exhibit erratic behavior. In the upper frequency region 134, the distance between the radiation devices as compared to wavelength is not as complimentary and the interference between the devices is most destructive. However, in the first upper frequency region 134, each individual radiation device may have its most precise pattern control. In this upper frequency region 134, as before, the electronic filtering may be altered to accommodate this change. The first upper frequency region 134 may typically define the fundamental radiation pattern for each device, as the primary transducer 104 may dominate in this region.

Two octaves above the center frequency is the second upper frequency region of operation. In the second upper frequency region, the interference patterns created are so dense (i.e., wavelengths are very small) such that radiation pattern shape of the primary transducer 104 is only marginally effected by the secondary transducer 106. Also, the second upper frequency region is where each individual device may have its least effective output capability. As such, the combination of the pair of radiation devices 104, 106 doubles the output capability of the overall system in the second upper frequency region, which may lower distortion and maintain good linearity in a region that normally suffers in this regard.

Unlike line-array loudspeakers that include a plurality of radiation devices all having the same radiation patterns, the loudspeakers 100, 120 of the present disclosure use one radiation pattern to sculpt a different radiation pattern, i.e. the secondary pattern 116 sculpts or manipulates the primary pattern 114 to achieve a resulting acoustic pattern that is different than either of the primary or secondary patterns. This requires each radiation pattern to be distinctly different. FIG. 3-6 illustrate polar plots of the dissimilar patterns of each of the transducers 104, 106 that can be combined to achieve a derived acoustic pattern that is different from each of the first and second radiation patterns 114, 116.

Figure 3:
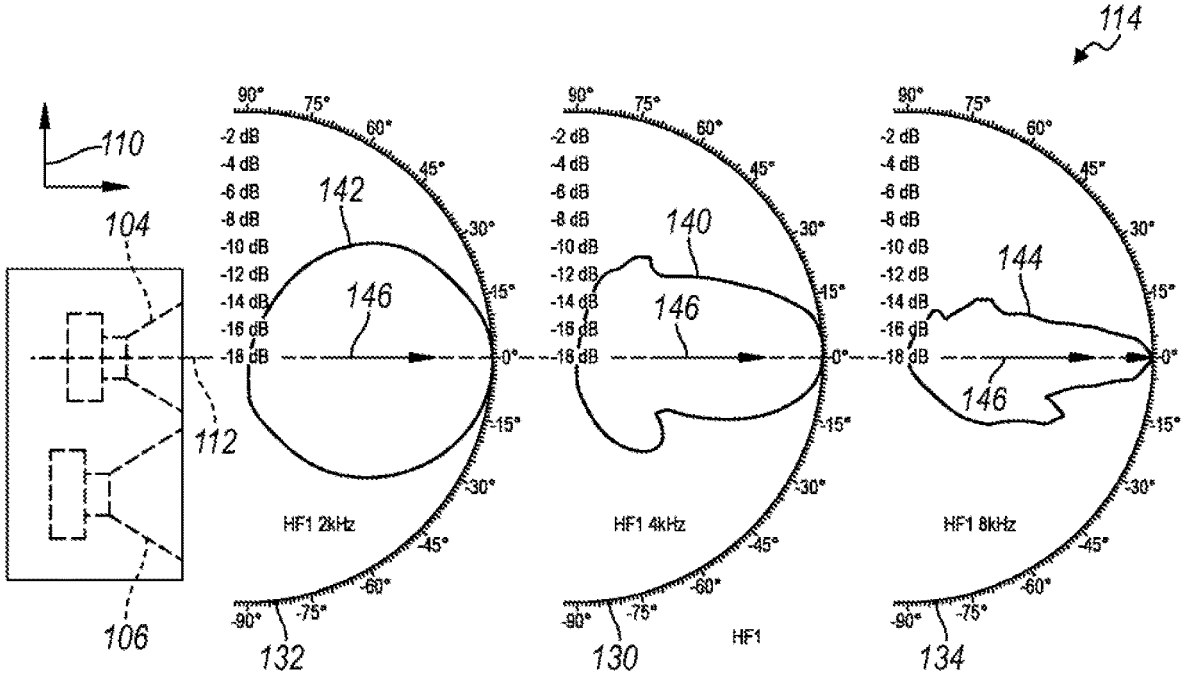
FIG. 3 is a series of polar plots illustrating exemplary individual acoustic radiation patterns of a first transducer in a vertical or primary plane at three different frequencies, according to one or more alternate embodiments of the present disclosure.
Figure 4:
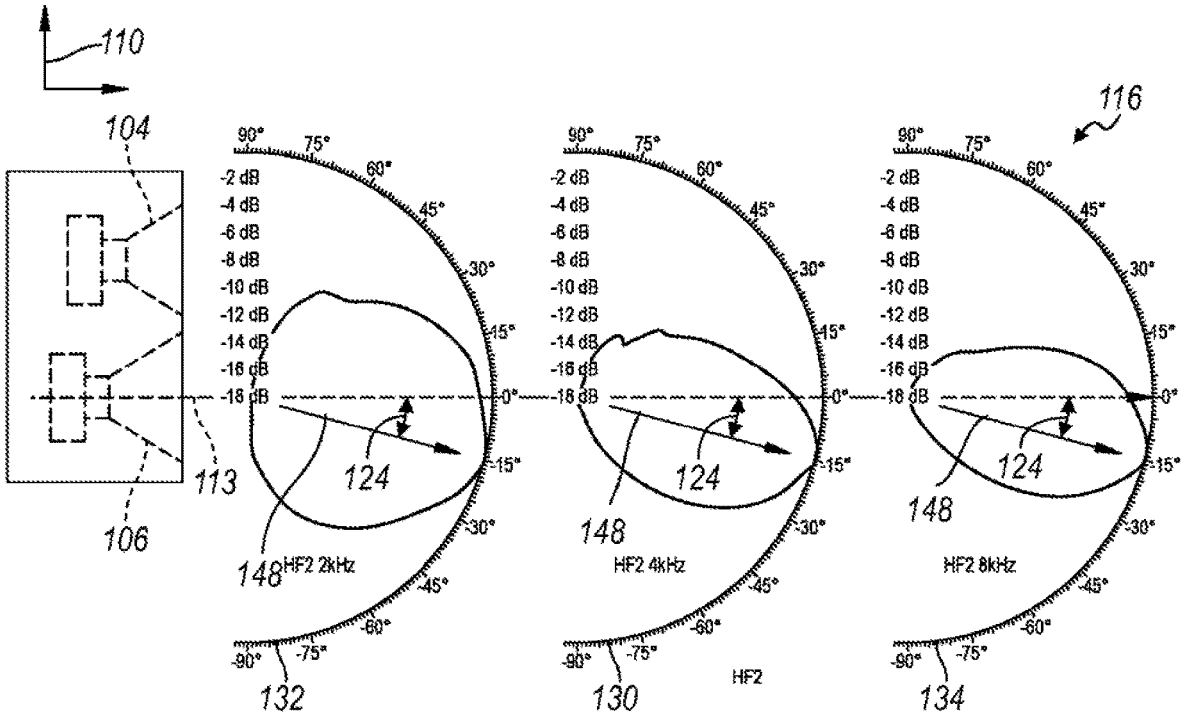
FIG. 4 is a series of polar plots illustrating exemplary individual acoustic radiation patterns of a second transducer in a vertical or primary plane at three different frequencies, according to one or more alternate embodiments of the present disclosure.

FIG. 3 is a series of polar plots illustrating exemplary individual acoustic radiation patterns 114 of the first or primary transducer 104 in the vertical or primary plane 110 at three different frequencies representing the major octaves of use. The series of polar plots show the frequency dependent behavior of the first transducer 104. For example, the center radiation shape shown is the radiation pattern 140 in the octave band of the design center frequency region 130. The left radiation shape shows the radiation pattern 142 in the octave band lower frequency region 132. The right radiation shape is the radiation pattern 144 in the octave band in the upper frequency region 134. As shown, the center frequency radiation pattern 140 is similar to the upper frequency radiation pattern 144 with the upper frequency radiation pattern 144 exhibiting more precision in shape. The lower frequency radiation pattern 144 shows loss of pattern control. Thus, showing clearly different filtering is required for each octave band. Of note is the first (primary) transducer 104 in the FIG. 3 example is not a typical single device and is a dual path radiator.

FIG. 4 is a series of polar plots illustrating exemplary individual acoustic radiation patterns 116 of the second or secondary transducer 106 in the vertical or primary plane 110 at three different frequencies representing the major octaves of use. These plots show a similar response for the second transducer 106 in center, lower and upper frequency regions 130, 132, 134 as in FIG. 5, even though the patterns are different. The second transducer 106 is an example of single device patterns typically exhibiting smooth and rounded shapes.

As also shown in FIGS. 3 and 4, the radiation patterns 116 for the second transducer 106 are different from the radiation patterns 114 for the first transducer 104. For example, the radiation patterns 116 for the secondary transducer 106 have an operational pattern axis 148 that is generally oriented at an operation angle 124 from the central axis of radiation 112 of the secondary transducer 106. As illustrated in FIG. 4, the operation angle 124 is approximately negative 15-degrees. As shown in FIG. 3, the radiation patterns 114 for the primary transducer 104 have an operational pattern axis 146 that is generally oriented along the central axis of radiation 112, so that the operation angle 124 is zero-degrees.

Figure 5:
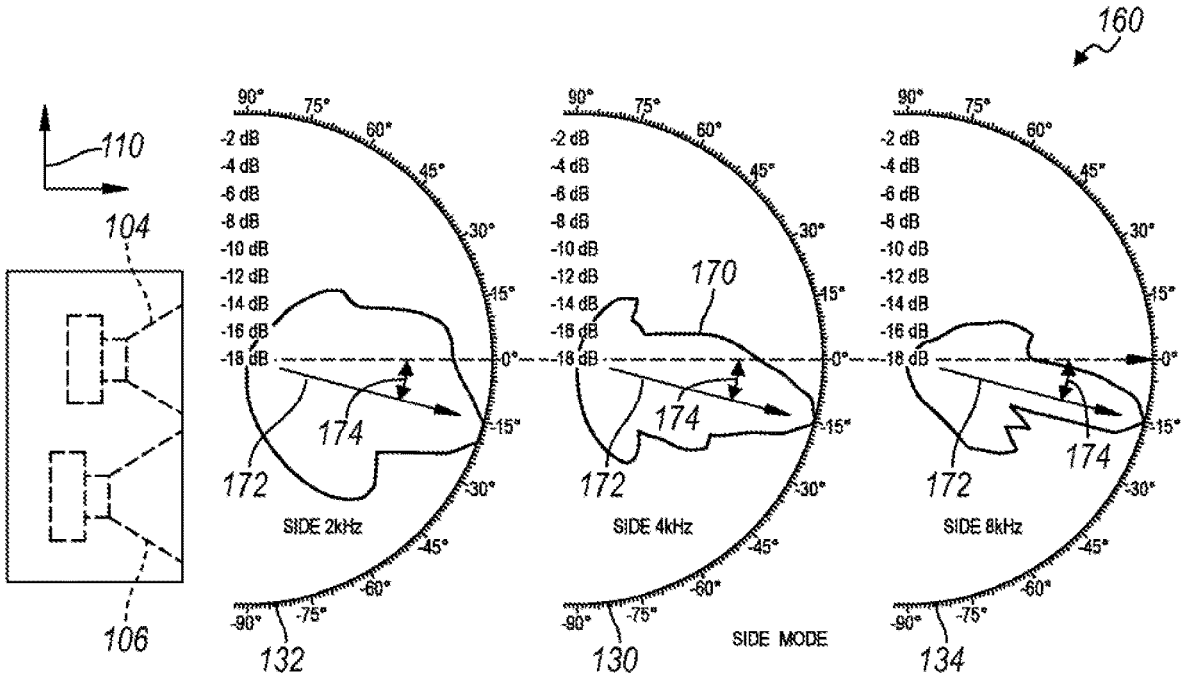
FIG. 5 is a series of polar plots illustrating exemplary acoustic radiation patterns derived from the individual patterns of the first and second transducers in the primary plane at three different frequencies in a side surround mode, according to one or more alternate embodiments of the present disclosure.

FIG. 5 is a series of polar plots illustrating exemplary acoustic radiation patterns 160 derived from the individual patterns 114, 116 of the first and second transducers 104, 106 in the primary plane 110 at three different frequencies representing the major octaves of use. In particular, FIG. 5 illustrates unique, derived acoustic radiation patterns 160 at center, lower and upper frequency regions 130, 132, 134 when the loudspeaker is in the side surround configuration mode. The derived acoustic radiation patterns 160 are sculpted to map uniformly in an actual use setting where the loudspeaker 100 is positioned along the upper sidewall of a cinema and is directed downward toward the audience while preventing a "hot spot" at locations close to the loudspeaker 100. A hot spot may be an area receiving sound at too high of a sound output level, or in other words, being too loud at a particular frequency. In this case, the lower half of the pattern may be the most critical. Overall shape consistency is important in terms of power response, while lower half shape is most important for direct field response uniformity. The consistency in this regard of the combination is much improved in comparing the same criteria with the single device patterns. Further, the derived operational radiation axis 172 of the derived acoustic radiation pattern 160 is oriented at a side operation angle 174 different than at least one of the operational axes 146, 148 of the pair of transducers 104, 106.

Figure 6:
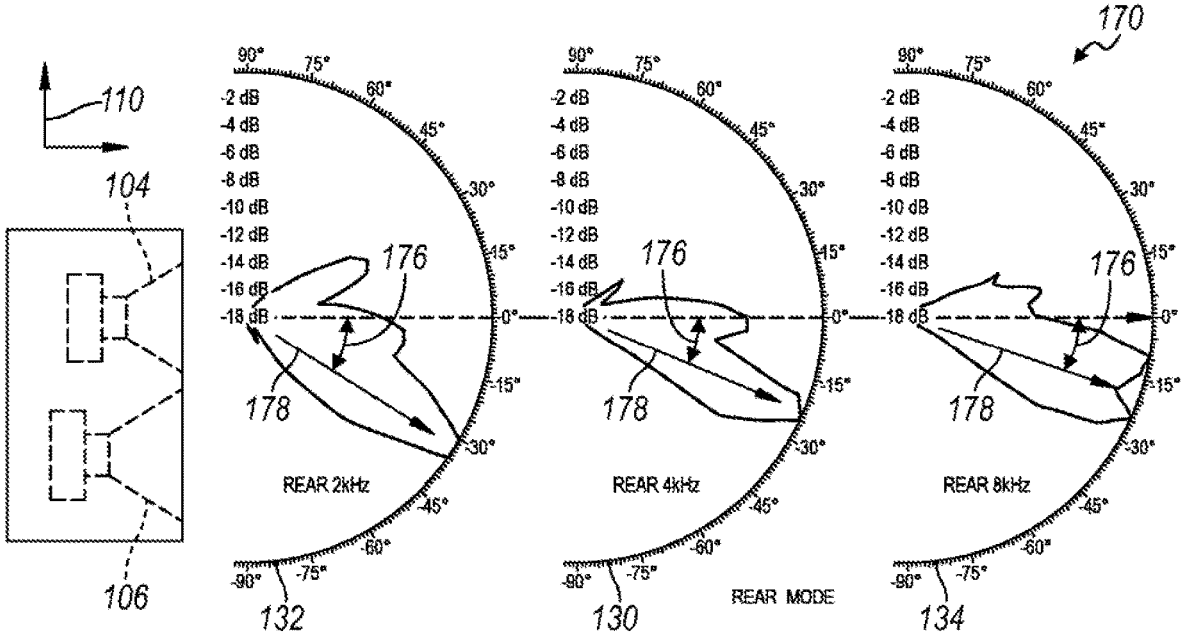
FIG. 6 is a series of polar plots illustrating exemplary acoustic radiation patterns derived from the individual patterns of the first and second transducers in the primary plane at three different frequencies in a rear surround mode, according to one or more alternate embodiments of the present disclosure.

FIG. 6 is another series of polar plots illustrating another acoustic radiation patterns 170 derived from the individual patterns derived from the individual patterns 114, 116 of the first and second transducers 104, 106 in the primary plane at three different frequencies representing the major octaves of use. In particular, FIG. 6 illustrates unique, derived acoustic radiation patterns 170 at center, lower and upper frequency regions 130, 132, 134 when the loudspeaker is in the rear surround configuration mode. The derived acoustic radiation patterns 170 shows even greater consistency in shape across all of center, lower and upper frequency regions 130, 132, 134. The derived acoustic radiation patterns 170 also shows a strong downward bias where the operational radiation axis 178 is oriented at a rear operation angle 176 which was required to map properly to the audience seating plane that slopes down and away from the loudspeaker positioned on a rear wall of a cinema. The derived operational radiation axis 178 of the derived acoustic radiation pattern 170 is oriented at a rear operation angle 176 different than both of the operational axes 146, 148 of the pair of transducers 104, 106.

It should be noted that anti-lobe creation can be a very useful design feature and may be used in one or more embodiments to eliminate coverage "hot spots" that often occur in actual application with single devices. The loudspeaker 100, 120 of the present disclosure has the ability to create and manipulate anti-lobes in strategic areas. For example, as shown in FIG. 7, the derived radiation pattern 160 reduces sound from an area that may be a hot-spot from one only one transducer by creating an anti-lobe 190.

In general, acoustic radiation devices aimed in the same direction intensify the energy lobe and those aimed in different directions spread the energy lobe. The loudspeaker 100, 120 according to the present disclosure has the ability to do both depending on the fundamental design variables. As already discussed, the design variables may include: (1) spacing and size of the pair of radiation devices 104, 106 with respect to each other; (2) the individual acoustic radiation patterns 114, 116 of the devices 104, 106; and (3) a position of each radiation device 104, 106 in a primary plane 110. These parameters may set the operating range of the resulting derived radiation pattern and its primary operational radiation axis. From this foundation, electronic filtering may then be used to manipulate the resulting radiation pattern within this framework. Alterations of any of the above variables can directly affect the derived radiation pattern.

When the wavefronts in the primary and secondary radiation patterns 114, 116 are in phase, they add, when out of phase, they subtract. The adding or subtracting can be controlled by electronic filtering or even polarity inversion. In this way, the outer fringes of a pattern can be controlled where it normally cannot.

Electronic filtering may be the primary tool used to manipulate the mix between the primary radiation pattern and the secondary radiation pattern. The reaction may be so dramatic that even the most basic form of filtering (e.g., analog passive) can produce good results, such as derived radiation patterns 160, 170. With better filter precision, such as finite impulse response (FIR) filtering, the derived radiation pattern shapes can become even more precise and consistent. Referring now to FIG. 7, a block diagram of the loudspeaker design is illustrated. As shown, the loudspeaker 100 may include an audio signal input 202 for receiving a single audio channel, such as a side surround audio signal or a rear surround audio signal.

The loudspeaker 100 may be set-up for a typical room configuration. For example, in the professional cinema surround application, theater shapes and sizes are relatively uniform. Accordingly, the loudspeaker 100 may be designed for such applications. Because a side surround speaker may "see" the theater room differently than a rear surround speaker, the loudspeaker may include a switch 204 for selectively changing between a side surround configuration and a rear surround configuration, or other configurations based on the sound requirements. Selecting the side surround configuration using the switch 204 may adjust filter settings of a passive network 205 to generate a unique radiation pattern sized and shaped for the room from the perspective that a side surround speaker typically "sees" in a cinema or other common environment depending on the application. For instance, as shown in FIG. 3, selecting the side surround configuration using the switch 204 may direct the audio signal through a primary filter (side mode) 206 corresponding to the primary (first) transducer 104 and a secondary filter (side mode) 208 corresponding to the secondary (second) transducer 106.

Likewise, selecting the rear surround configuration using the switch 204 may adjust filter settings to generate a unique radiation pattern sized and shaped for the room from the perspective that a rear surround speaker typically "sees." Specifically, selecting the rear surround configuration using the switch 204 may direct the audio signal through a primary filter (rear mode) 210 corresponding to the primary (first) transducer 104 and a secondary filter (rear mode) 212 corresponding to the secondary (second) transducer 106. The filter settings for the primary filters 206, 210 may differ between the side mode and the rear mode. Similarly, the filter settings for the secondary filters 208, 212 may differ between the side mode and the rear mode as well.

According to one or more embodiments, in-field adjustment of the filter parameters for more specific room customization may be possible for certain other speaker applications. This may be accomplished by bi-amplifying the pair of radiation devices 104 and including a digital signal processor (DSP) 214, as shown in FIG. 4. The DSP 214 may be employed for specifically tuning a primary filter 216 and a secondary filter 218 in the field.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A dual-array loudspeaker comprising:

a primary transducer producing a primary radiation pattern having a primary central axis of radiation in a primary plane and operating at a primary operation angle; and a secondary transducer positioned a distance in the primary plane from the primary transducer and producing a secondary radiation pattern having a secondary operation angle different than a secondary central axis of radiation, the secondary pattern different from the primary radiation pattern in the primary plane, wherein the central axes of radiation of the primary and secondary transducers are generally parallel and spaced apart by the distance in the primary plane, wherein the secondary radiation pattern modifies the primary radiation pattern to produce a derived primary radiation pattern different from the primary and secondary radiation patterns in the primary plane, and having a derived primary axis of radiation oriented at a derived operation angle different than the primary or secondary central axes of radiation and different than primary operation angle, wherein the derived operation angle of the derived primary axis of radiation is different than both the primary and secondary operation angles of the primary and secondary transducers on the primary plane.

2. The dual-array loudspeaker of claim 1 wherein the primary plane is a vertical plane.

3. The dual-array loudspeaker of claim 1 wherein the primary and secondary transducers have a center frequency being generally the same and the distance the primary and secondary transducers are spaced apart by is generally equal to 1.5 times the center frequency of the primary and secondary transducers, wherein the distance is measured between the central axis of radiation of the primary transducer and the central axis of radiation of the secondary transducer.

4. The dual-array loudspeaker of claim 1 wherein the secondary transducer operates at a sound output level being less than a primary sound output level of the primary transducer.

5. The dual-array loudspeaker of claim 1 wherein at least one of the primary and secondary transducers includes a first electronic filtering mode and a second electronic filtering mode, wherein the derived primary radiation pattern has a first derived radiation pattern at a first derived operation angle based on the first electronic filtering mode and a second derived radiation pattern at a derived second operation based on the second electronic filtering mode, wherein the first derived operation angle is different than the second derived operation angle.

6. The dual-array loudspeaker of claim 5 wherein the first electronic filtering mode is a side mode and the second electronic filtering mode is a rear mode.

7. The dual-array loudspeaker of claim 1 wherein the primary transducer is different than the secondary transducer.

8. A dual-array loudspeaker comprising:

a first transducer having a first central axis of radiation and producing a first radiation pattern oriented at a first operation angle from the first central axis of radiation;

a second transducer different than the first transducer and having a second central axis of radiation spaced apart and generally parallel to the first central axis of radiation and producing a second radiation pattern oriented at a second operation angle from the second central axis of radiation; and wherein a derived radiation pattern has a derived operation axis of radiation oriented at a derived operation angle different than the first and second central axis of radiation when the first and second radiation patterns are combined;

wherein the derived operation angle of the derived operation axis of radiation is different than both the first and second operation angles of the first and second transducers on the primary plane.

9. The dual-array loudspeaker of claim 8 wherein the derived operation angle is not parallel to the first and second central axes of radiation.

10. The dual-array loudspeaker of claim 8 wherein the first transducer has a first filtering function operating the first transducer at a first operation angle and the second transducer has a second filtering function different than the first filtering function operating the second transducer at a second operation angle.

11. The dual-array loudspeaker of claim 8 wherein the first and second central axes of radiation lie on a primary plane.

12. The dual-array loudspeaker of claim 11 wherein the first and second central axes of radiation are generally parallel and spaced apart by a distance in the primary plane, wherein the primary and secondary transducers have a center frequency being generally the same and the distance the primary and secondary transducers are spaced apart by is generally equal to 1.5 times the center frequency of the primary and secondary transducers, wherein the distance is measured between the central axis of radiation of the primary transducer and the central axis of radiation of the secondary transducer.

13. The dual-array loudspeaker of claim 11 wherein the primary plane is a vertical plane.

14. The dual-array loudspeaker of claim 8 wherein the dual-array only comprises a pair of transducers.

15. A method comprising:

generating a primary radiation pattern with a primary transducer having a primary central axis of radiation and operating at a primary operation angle;

generating a secondary radiation pattern with a secondary transducer different than the primary transducer, having a secondary central axis of radiation generally parallel and spaced apart by a distance in the primary plane and operating at a secondary operation angle; and manipulating the primary radiation pattern with the secondary radiation pattern to produce a derived primary radiation pattern different from the primary and secondary radiation patterns and having a derived operation axis of radiation oriented at an operating angle different than the primary and secondary central axes of radiation, wherein the derived operation angle of the derived primary axis of radiation is different than both the primary and secondary operation angles of the primary and secondary transducers on the primary plane.

16. The method of claim 15 further comprising positioning the secondary transducer a distance away in a primary plane from the primary transducer, wherein, the primary and secondary transducers have a center frequency being generally the same and the distance the primary and secondary transducers are spaced apart by is generally equal to 1.5 times the center frequency of the primary and secondary transducers, wherein the distance is measured between the central axis of radiation of the primary transducer and the central axis of radiation of the secondary transducer.

17. The method of claim 15 further comprising:

changing a filtering function of at least one of the primary and secondary transducers; and changing the derived primary radiation pattern from a first mode having a first derived central axis of radiation to a second mode having a second derived central axis of radiation in response to changing the filtering function, wherein the first derived central axis of radiation is different than the second derived central axis of radiation.

18. The method of claim 15 wherein the derived operation axis of radiation is oriented at the derived operation angle being different than an operation angle of the primary and secondary transducers.

19. The method of claim 15 further comprising operating the primary transducer at a primary sound output level being greater than a secondary sound output level of the secondary transducer.

* * * * *